US006182653B1

(12) United States Patent
Otenbaker et al.

(10) Patent No.: US 6,182,653 B1
(45) Date of Patent: Feb. 6, 2001

(54) EXHAUST HOOD

(75) Inventors: James T. Otenbaker, Homosassa, FL (US); Frederick F. Fritz, Stanwood, MI (US)

(73) Assignee: Randell Manufacturing, Inc., Weidman, MI (US)

( * ) Notice: Under 35 U.S.C. 154(b), the term of this patent shall be extended for 0 days.

(21) Appl. No.: 09/259,855

(22) Filed: Mar. 1, 1999

(51) Int. Cl.[7] ..... F24C 15/20

(52) U.S. Cl. ..... 126/299 R; 126/299 D; 55/DIG. 36; 454/67

(58) Field of Search ..... 126/299 R, 299 D, 126/299 F, 300, 301, 312, 21 R; 55/DIG. 36; 99/444, 445, 446; 454/49, 56, 61, 67

(56) References Cited

U.S. PATENT DOCUMENTS 3,411,428 * 11/1968 Ahlrich ..... 126/300
3,537,442 * 11/1970 Berger ..... 126/299 R
4,047,519 * 9/1977 Nett ..... 126/299 D
4,323,373 * 4/1982 Fritz ..... 126/299 D
4,700,688 10/1987 Searcy et al. ..... 126/299 D
4,827,903 * 5/1989 Kim ..... 126/299 R
4,896,657 * 1/1990 Glassman ..... 126/299 D
5,522,377 6/1996 Fritz ..... 126/299 R
5,524,607 * 6/1996 Grohman et al. ..... 126/299 R
5,927,268 * 7/1999 Chiang et al. ..... 126/299 R

* cited by examiner

*Primary Examiner*—Ira S. Lazarus
*Assistant Examiner*—Josiah C. Cocks
(74) *Attorney, Agent, or Firm*—Rader, Fishman, Grauer & Mc Garry

(57) ABSTRACT

An exhaust hood having an inverted V-shaped interior, the walls comprising the inverted V including grease filters and the apex of the inverted V lying adjacent to an exhaust duct to be placed in communication with an exhaust fan. The interior of the hood thus being shaped like an inverted funnel, rising gases and entrained contaminants are directed to the grease filters and thence to the exhaust duct.

15 Claims, 4 Drawing Sheets

EXHAUST HOOD

BACKGROUND OF THE INVENTION

1. Field of the Invention

This invention relates to an exhaust hood for moving air laden with grease, smoke, vapors, or other contaminants or particulates from a working environment, and more specifically, to such an exhaust hood having an inverted V-shaped transverse configuration for more efficiently funneling the contaminated air from the working environment.

2. Related Art

Exhaust hoods are employed in a variety of environments such as kitchens, laboratories, and commercial food-preparation spaces, in which there are typically several cooking units aligned in a row. Some of these units; e.g., boilers and fryers, may produce considerable quantities of smoke, fumes, grease particles and moisture, while other units, e.g., ranges and griddles, may generate pollutants in substantially smaller amounts. Kitchen exhaust ventilation systems have traditionally been designed with enough airflow capacity to remove pollutants from broilers, fryers, and more active pollution-generating cooking units.

Because of the amount of negative pressure necessary to remove a large volume of contaminants, operating these exhaust ventilators is costly. More particularly, most island-type commercial exhaust hoods having a grease filtering capability include a grease filter installed in the center of the hood cavity at approximately 45° from horizontal in a V-shape having a downwardly directed apex and running the full length of the hood. This configuration is shown as FIG. 1, labeled Prior Art. The principal of operation of this prior art configuration is to create enough negative air pressure in front of the filter in order to capture the heat, smoke, grease and other airborne contaminants and remove them from the working environment.

The negative air pressure downstream of these grease filters must be substantial enough to alter the vertical direction of the hot contaminated air created in the cooking process and draw it toward and then into the grease filters. Failure to exhaust sufficient volumes of air through the filters will result in some hot contaminated air becoming trapped in the hood cavity rather than being exhausted through the filters. Once the hood cavity is filled with the hot, vertically rising, contaminated air that has not been captured by the grease filters, it will begin to escape around the lower edges of the hood into the room or other working space.

The prior-art solution for the foregoing problem, which is commonplace in island-type food preparation surfaces, is to exhaust larger quantities of air through the grease filters until the negative air pressure created is high enough to alter the direction of the vertical air flow toward the grease filter. This requires an exhaust fan; a motor; and a heating, ventilation, and air conditioning ("HVAC") system capable of handling a larger volume of airflow, which, consequently, means higher construction cost when installing the system and higher utility costs when operating the system.

What has been needed is a more efficiently and economically designed hood requiring a smaller or less powerful exhaust fan, motor, and HVAC system, yet providing effective exhaustion of contaminated air.

SUMMARY OF THE INVENTION

In its broader aspects, the present invention provides an exhaust hood comprising a housing having a pair of opposing end panels and an open underside. Interior surfaces form an inverted V in transverse section, the interior surfaces and the end panels defining a cavity extending upwardly within the housing from the open underside. At least one filter provides at least a portion of the interior surfaces. An exhaust outlet is formed in the housing above the apex of the inverted V formed by the interior walls, the exhaust outlet being in fluid communication with the cavity by way of the filter. The cavity and the exhaust outlet thereby provide a flow path in the manner of an inverted funnel for rising gases and entrained contaminants.

In preferred embodiments of the invention, the housing includes an upper panel, the end panels depending from the upper panel. A pair of grease filters is supported within an upper portion of the housing, the grease filters extending between the end panels and sloping downwardly and outwardly in opposite directions from a central portion of the housing. A pair of interior walls are supported within the housing in spaced relation to each other, each of the interior walls extending between the end panels below a respective one of the grease filters and sloping downwardly and outwardly in planes parallel to the planes of the respective grease filter. Thus, the grease filters and the interior walls define the cavity in an inverted V-shape in transverse section. An exhaust plenum is formed in the housing above the apex of the inverted V formed by the interior walls and the grease filters, the exhaust plenum being in fluid communication with the cavity by way of the grease filters. The exhaust outlet is formed in the upper panel of the housing and is in fluid communication with the exhaust plenum, whereby the exhaust plenum, together with the cavity and the exhaust outlet, provides the flow path in the manner of an inverted funnel for the rising gases and entrained contaminants.

The housing preferably includes a pair of side panels depending from the upper panel and extending between the end panels.

A grease drain system is also preferably provided, in which each of a pair of grease troughs, removably supported within the cavity, extends along a lower edge of a respective one of the grease filters. A removable grease cup is supported on one of the end panels, a first one of the grease troughs having an open end disposed above the grease cup, whereby grease draining from the respective grease filter is caught by the first grease trough and deposited in the cup by way of the open end of the first grease trough. A grease drain in the form of a channel is supported on the same end panel at an angle from the horizontal. The other grease trough also has an open end, the grease drain having an upper end disposed below the open end thereof, and a lower end disposed above the grease cup. Thus, grease draining from the second grease filter is caught by the other grease trough, directed to the grease drain by way of the open end of such other grease trough, and deposited in the grease cup by way of the lower end of the grease drain.

Also in preferred emodiments, each of a pair of grease catches extends between the end panels along a lower edge of a respective one of the interior walls.

The exhaust hood of the present invention provides a simple and more effective solution to the problem of providing adequate air exhaustion at a lower cost by providing an exhaust hood having an inverted V-shaped interior, wherein the walls comprising the inverted V include grease filters and the apex of the inverted V lies adjacent an exhaust duct in communication with an exhaust fan. Because the hood is thereby shaped like an inverted funnel, the naturally rising hot airflow must move toward the grease filters and exhaust duct. Thus, a relatively large negative pressure is not necessary to alter the airflow direction; instead, only negative pressure sufficient to draw the adjacent air through the duct is required. Consequently, a smaller exhaust fan and motor can be used. Also, a lower-powered HVAC system for exhausting air from the building may be employed. All these factors act in concert to lower building and utility costs.

Other features and advantages of the invention will be apparent from the ensuing description in conjunction with the accompanying drawings.

DETAILED DESCRIPTION

Figure 1:
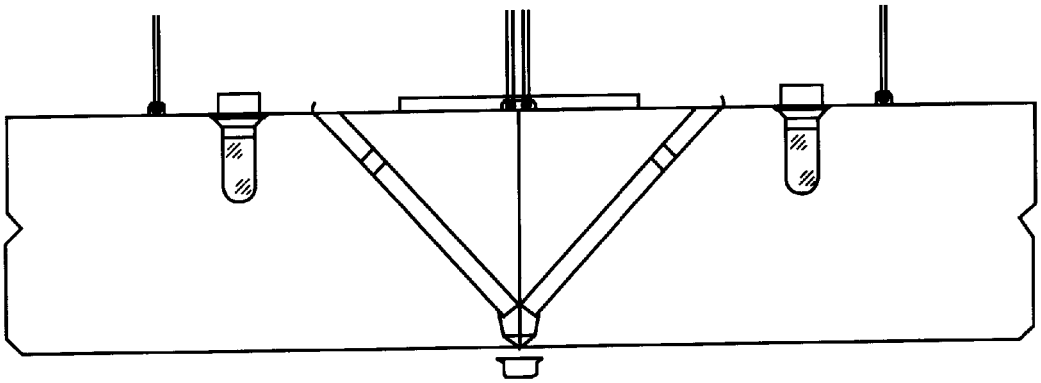
Fig. 1 (PRIOR ART)
FIG. 1 is a perspective view of a prior art exhaust hood.
Figure 2:
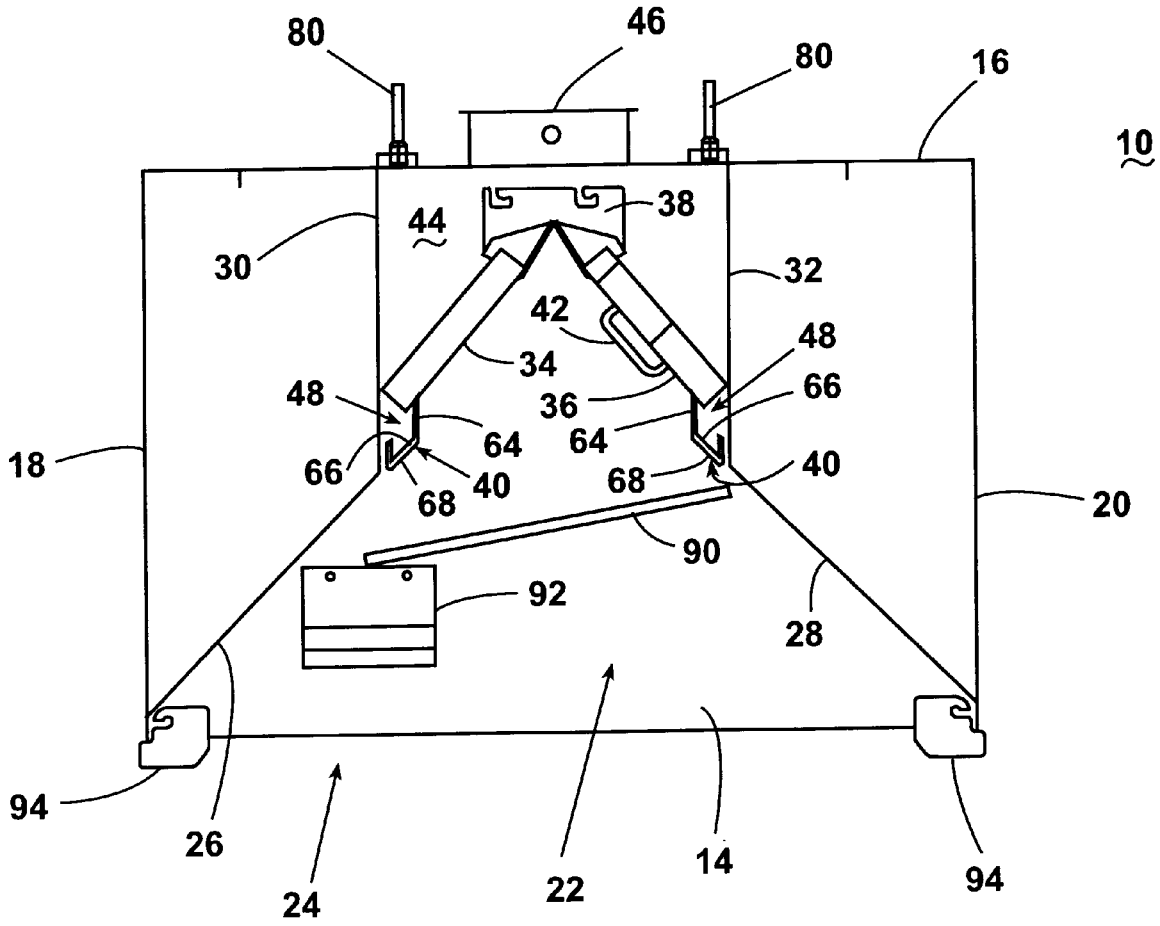
FIG. 2 is a sectional view of an exhaust hood according to the invention taken along line 2—2 of FIG. 3.
Figure 3:
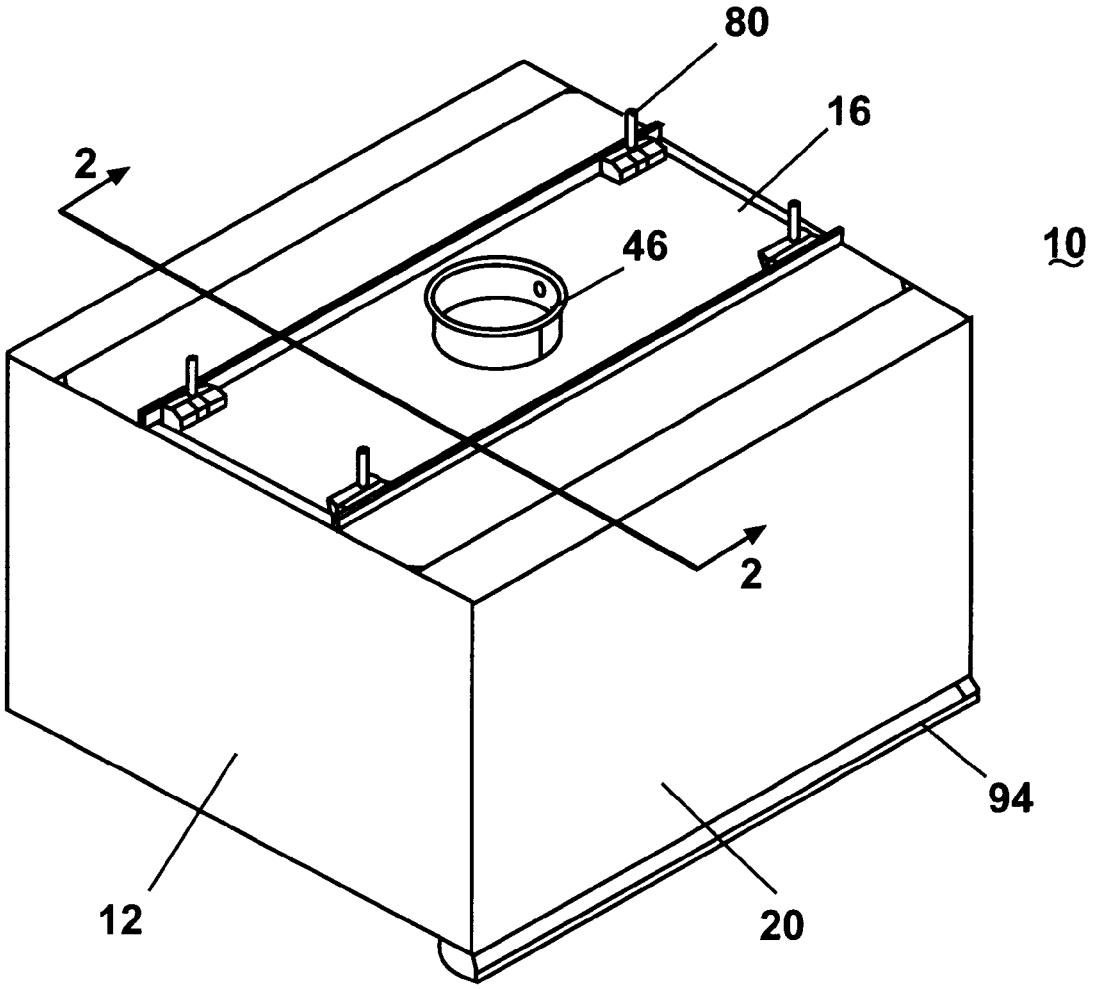
FIG. 3 is a perspective view of the exhaust hood of FIGS. 2 and 3.
Figure 4:
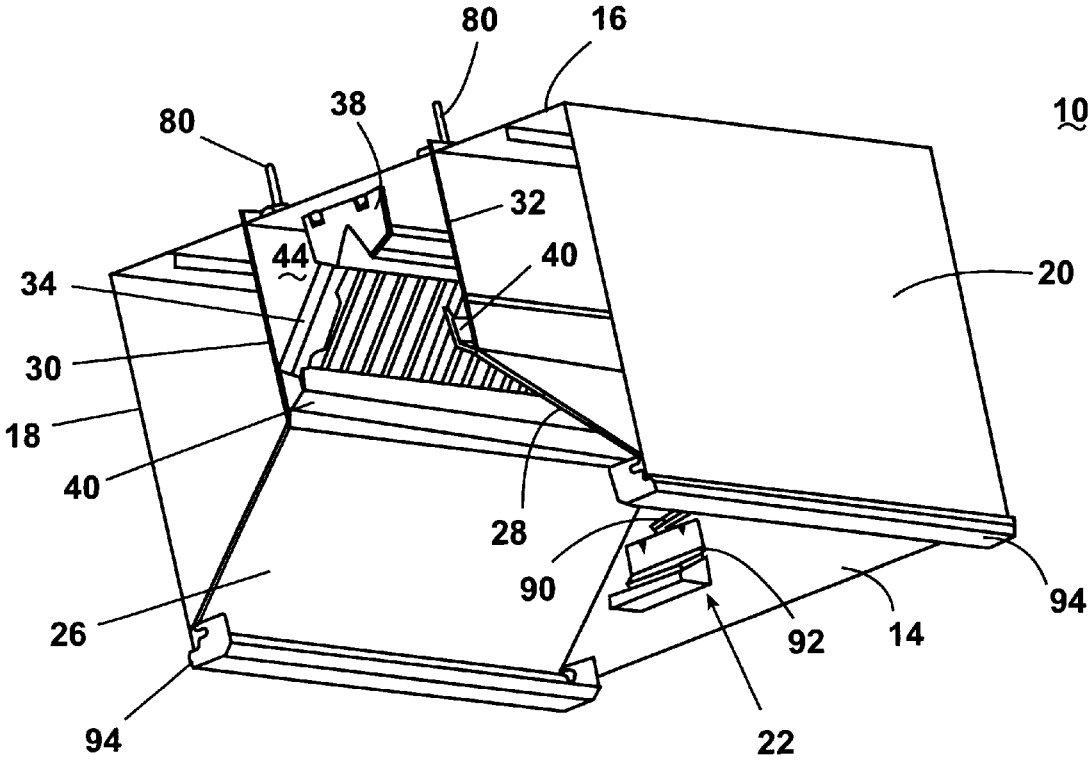
FIG. 4 is another perspective view of the exhaust hood of FIGS. 2 and 3, shown with a front panel removed.

Referring now to FIGS. 2 to 4, an exhaust hood 10 is shown including a housing having front and rear end panels 12, 14, an upper panel 16, and side panels 18, 20, which form a generally rectangular box-like structure defining an inverted V-shaped cavity 22 and having an open underside 24. Interior walls 26, 28 slope upwardly from the underside 24 at the edges adjacent to the side panels 18, 20, respectively, towards the center of the upper panel 16. At their uppermost ends, the interior walls 26, 28 meet vertical upstanding walls 30, 32, which connect the interior walls 26, 28 to the upper panel 16. Preferably, the interior walls 26, 28 in the housing are comprised of stainless steel or aluminized steel. A pair of grease filters 34, 36 extend angularly upwardly from the interior walls 26, 28, respectively, to a removable filter carrier 38, which defines the apex of the inverted V-shaped cavity 22.

An exhaust plenum 44 is defined by the grease filters 34, 36; the filter carrier 38; upstanding walls 30, 32; and the upper panel 16. An exhaust duct 46 stands upwardly and outwardly from the exhaust plenum 44 through the upper panel 16. Suction or negative pressure applied to the exhaust duct 46, as by an exhaust fan (not shown) draws air from the exhaust plenum 44 out of the exhaust hood 10 through the exhaust duct 46.

Typically, an exhaust hood such as the hood 10 will have several grease filters 34, 36 arranged in side-by-side arrangement to span the full length of the exhaust hood. The grease filters 34, 36 slope upwardly and forwardly at an angle of approximately 45°, in planes respectively parallel with the interior walls 26, 28. The grease filters 34, 36 are mounted in the filter carrier 38 and a lower bracket 48, which jointly retain the grease filters 34, 36. The grease filters 34, 36, include removable grease troughs 40 at a lower end adjacent the interior walls 26, 28, and a handle 42 for aiding installation and removal. Preferably, the grease filters 34, 36 are ten-inch, UL listed baffle filters. The lower bracket 48 includes the removable grease trough 40, which has a downwardly depending arm 64 mounting a U-shaped channel 66, including an exterior face 68 extending at the same angle as the interior walls 26, 28.

Below the removable grease troughs 40 extends a grease drain 90, which is a channel angled downwardly and including an end disposed above a grease cup 92 removably supported by the rear panel 14. Thus, as grease is removed by the filters 34, 36, it drains from the filters to the removable grease troughs 40, which channel the grease to the grease drain 90, which lies below an end of the grease trough. In turn, the grease drain 90 channels the grease to the grease cup 92, which can be emptied by simply removing it from the rear panel 14.

The grease troughs 40 may preferably be open at each of their ends and the grease drain 90 and the removable grease cup 92 duplicated at the front end panel 12 in mirror image to facilitate the draining of grease from the filters 34, 36.

Removable grease catches 94 line the bottom surfaces of the interior walls 26, 28 for accumulating the grease that will accumulate on the interior walls 26, 28 and flow or slide down the walls by force of gravity. The removable grease catches 94 store the accumulated grease until they are emptied by simply removing the grease catch from the lower edges of the interior walls 26, 28.

The upper panel 16 includes hanging rods 80 for connecting the hood 10 to a support surface (not shown). Preferably, four hanging rods 80 are respectively disposed adjacent to the corners of the upper panel 16. Of course, for a larger hood 10, a greater number of hanging rods may be required.

In a typical commercial kitchen installation, the cooking equipment will be oriented beneath the exhaust hood 10. The design described above is particularly adapted for an island-style preparation surface; that is, a preparation surface that is approachable from each end. Such an island-style preparation surface requires that the exhaust hood 40 be supported by the ceiling, via the hanging rods 80, whereby the hood 10 is mounted above the preparation surface. After the kitchen equipment has been placed in the desired arrangement, the exhaust fan is operated so that smoke, fumes, and grease, such as from broilers and fryers, are exhausted from the room or other working space. The smoke, fumes, and grease are funneled inwardly towards the plenum 44 by the inwardly and upwardly extending interior walls 26, 28 toward the grease filters 34, 36.

As described previously, grease drains from the filters to the grease troughs 40, which channel grease to the drain 90. The drain 90 channels the grease to the grease cup 92, which can be removed to empty accumulated grease. The troughs 40, drain 90 and cup 92 are removable to aid in cleaning the components.

While the invention has been specifically described in connection with certain specific embodiments thereof, it is to be understood that this is by way of illustration and not of limitation, and the scope of the appended claims should be construed as broadly as the prior art will permit.

What is claimed is:

1. An exhaust hood comprising:

a housing having a pair of opposing end panels and an open underside;

interior surfaces forming an inverted V in transverse section, the interior surfaces and the end panels defining a cavity extending upwardly within the housing from the open underside;

at least one filter providing at least a portion of the interior surfaces; and an exhaust outlet formed in the housing above the apex of the inverted V formed by the interior walls, the exhaust outlet being in fluid communication with the cavity by way of the filter;

whereby the cavity and the exhaust outlet provide a flow path in the manner of an inverted funnel for rising gases and entrained contaminants.

2. An exhaust hood according to claim 1, including a grease trough disposed within the cavity and extending along a lower edge of the filter.

3. An exhaust hood according to claim 2, including a removable grease cup supported on one of the end panels, the grease trough having an open end disposed above the grease cup, whereby grease draining from the filter is caught by the grease trough and deposited in the cup by way of the open end of the grease trough.

4. An exhaust hood according to claim 2, including a removable grease cup supported on one of the end panels, and a grease drain in the form of a channel supported on said one end panel at an angle from the horizontal, the grease trough having an open end, the grease drain having an upper end thereof disposed below the open end of the grease trough, and a lower end thereof disposed above the grease cup, whereby grease draining from the filter is caught by the grease trough, directed to the grease drain by way of the open end of the grease trough, and deposited in the grease cup by way of the lower end of the grease drain.

5. An exhaust hood according to claim 1, including a removable grease catch extending between the end panels along a lower edge of the interior surfaces.

6. An exhaust hood comprising:

a housing having an upper panel, a pair of opposing end panels depending from the upper panel, and an open underside;

a pair of grease filters supported within an upper portion of the housing, the grease filters extending between the end panels and sloping downwardly and outwardly in opposite directions from a central portion of the housing;

a pair of interior walls supported within the housing in spaced relation to each other; each of the interior walls extending between the end panels below a respective one of the grease filters and sloping downwardly and outwardly in planes parallel to the planes of said respective one of the grease filters;

the grease filters and the interior walls defining a cavity having an inverted V-shape in transverse section and extending upwardly within the housing from the open underside between the end walls;

an exhaust plenum formed in the housing above the apex of the inverted V defined by the grease filters and the interior walls, the exhaust plenum being in fluid communication with the cavity by way of the grease filters; and an exhaust outlet formed in the upper panel, the exhaust outlet being in fluid communication with the exhaust plenum;

whereby the cavity, the exhaust plenum, and the exhaust outlet provide a flow path in the manner of an inverted funnel for rising gases and entrained contaminants.

7. An exhaust hood according to claim 6, wherein the housing includes a pair of side panels depending from the upper panel and extending between the end panels.

8. An exhaust hood according to claim 6, including a removable filter carrier supporting the grease filters and defining the apex of the inverted V of the cavity.

9. An exhaust hood according to claim 6, including a pair of grease troughs, each of the grease troughs extending along a lower edge of a respective one of the grease filters.

10. An exhaust hood according to claim 9, wherein the grease troughs are removably supported within the cavity.

11. An exhaust hood according to claim 9, including a removable grease cup supported on one of the end panels, one of the grease troughs having an open end disposed above the grease cup, whereby grease draining from the respective one of the grease filters is caught by said one grease trough and deposited in the cup by way of the open end of the grease trough.

12. An exhaust hood according to claim 11, including a grease drain in the form of a channel supported on said one end panel at an angle from the horizontal, the other of the grease troughs having an open end, the grease drain having an upper end thereof disposed below the open end of said other grease trough, and a lower end thereof disposed above the grease cup, whereby grease draining from said other grease filter is caught by said other grease trough, directed to the grease drain by way of the open end of said other grease trough, and deposited in the grease cup by way of the lower end of the grease drain.

13. An exhaust hood according to claim 9, including a pair of removable grease cups, each of the grease cups being supported on a respective one of the end panels, one of the grease troughs being open at both ends thereof, the open ends of said one grease trough being disposed above the grease cups, whereby grease draining from the respective one of the grease filters is caught by said one grease trough and deposited in the grease cups by way of the open ends of the grease trough.

14. An exhaust hood according to claim 13, including a pair of grease drains, each of the grease drains being in the form of a channel supported on a respective one of the end panels at an angle from the horizontal, the other of the grease troughs being open at both ends thereof, each of the grease drains having an upper end thereof disposed below a respective one of the open ends of the said other grease trough, and a lower end thereof disposed above the respective grease cup, whereby grease draining from said other grease filter is caught by said other grease trough, directed to the grease drains by way of the open ends of said other grease trough, and deposited in the grease cups by way of the lower ends of the grease drains.

15. An exhaust hood according to claim 6, including a pair of removable grease catches, each of the grease catches extending between the end panels along a lower edge of a respective one of the interior walls.

* * * * *